US006062731A

United States Patent [19]

Guzik

[11] Patent Number: 6,062,731

[45] Date of Patent: May 16, 2000

[54] ELECTROPLATED LEAD SURFACE COATING FOR AN X-RAY TUBE CASING

[75] Inventor: Jadwiga B. Guzik, Dousman, Wis.

[73] Assignee: General Electric Company, Milwaukee, Wis.

[21] Appl. No.: 09/139,497

[22] Filed: Aug. 25, 1998

[51] Int. Cl.[7] ..... H01J 35/16

[52] U.S. Cl. ..... 378/203; 378/200; 378/202

[58] Field of Search ..... 378/200, 202, 378/199, 201, 203, 141, 140, 130

[56] References Cited

U.S. PATENT DOCUMENTS

| | | | |
|---|---|---|---|
| 2,164,997 | 7/1939 | Machlett | 378/200 |
| 3,859,534 | 1/1975 | Loughlin | 378/200 |
| 4,964,148 | 10/1990 | Klostermann et al. | 378/127 |

*Primary Examiner*—David P. Porta
*Attorney, Agent, or Firm*—B. Joan Haushalter; Christian G. Cabou; Phyllis Y. Price

[57] ABSTRACT

The present invention provides for an adherent and durable coating for a lead-lined x-ray tube casing which is exposed to dielectric cooling oil. Electroplating lead radiation shield material with a corrosion resistant and nontoxic material having excellent solderability, softness and ductility, provides a clean corrosion resistant surface which is inert to the oil, independent of temperature and x-ray irradiation. The electroplating material preserves the lead surface from flaking and corroding to the oil. The electroplating material is preferably selected from the group consisting of tin, silver, copper and nickel, or various combinations of those or other materials capable of providing an adherent and durable coating for the x-ray tube casing.

13 Claims, 3 Drawing Sheets

ELECTROPLATED LEAD SURFACE COATING FOR AN X-RAY TUBE CASING

TECHNICAL FIELD

The present invention relates to x-ray tube casings and, more particularly, to an x-ray tube casing coating for preventing lead contamination of oil.

BACKGROUND OF THE INVENTION

The x-ray tube has become essential in medical diagnostic imaging, medical therapy, and various medical testing and material analysis industries. Typical x-ray tubes are built with a rotating anode structure for the purpose of distributing the heat generated at the focal spot. The anode is rotated by an induction motor comprising a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The x-ray tube cathode provides a focused electron beam which is accelerated across the anode-to-cathode vacuum gap and produces x-rays upon impact with the anode.

The casings of x-ray tubes are lined with lead to prevent the leakage of x-rays in directions other than through the window of the tube. This lead is exposed to a dielectric cooling oil which removes heat from the tube insert during operation. X-ray exposure causes a gradual breakdown in the oil forming smaller and less saturated compounds. The lead readily oxidizes and a combination of this oxide and particles on the lead surface make coating the lead necessary to prevent oil contamination.

Currently, various epoxy type paints are used to coat tube casings and prevent leakage of the x-rays. Unfortunately, the lead which lines the casings of x-ray tubes provides a poor surface for adherence. Hence, the hot oil, x-rays and chemicals generated during the x-ray exposure of the oil all gradually promote flaking of the paint from the surface. Furthermore, the enamel and epoxy paints currently used to coat tube casings are susceptible to peeling and scratching during assembly. The particles created by the flaking, peeling and scratching cause tube instability and tube failure. In addition, the casings often require manual touch-up of the paint, and paint damaged during handling and assembly creates rework requirements as well. All of these problems impact casing quality and availability and increase the casing cost.

It is seen, then, that it would be desirable to have a more adherent, durable and long-lasting coating for x-ray tube casings which can overcome the problems of prior art tube casing coatings.

BRIEF SUMMARY OF THE INVENTION

The present invention provides for electroplating of the lead surface of x-ray tube casings, as a replacement for the paint coatings currently used in the art.

In accordance with one aspect of the present invention, an adherent and durable coating is provided for a lead-lined x-ray tube casing which is exposed to dielectric cooling oil. Electroplating lead radiation shield material with a corrosion resistant and nontoxic material having excellent solderability, softness and ductility, provides a clean corrosion resistant surface which is inert to the oil, independent of temperature and x-ray irradiation. The electroplating material preserves the lead surface from flaking and corroding to the oil. The electroplating material is preferably selected from the group consisting of tin, silver, copper and nickel, or various combinations of those or other materials capable of providing an adherent and durable coating for the x-ray tube casing.

Accordingly, it is an object of the present invention to provide electroplated lead surface coating for x-ray tube casings. It is a further object to provide such a coating which will be more adherent and durable, and longer-lasting than coatings of the prior art.

Other objects and advantages of the invention will be apparent from the following description, the accompanying drawings and the appended claims.

DETAILED DESCRIPTION OF THE INVENTION

Figure 1:
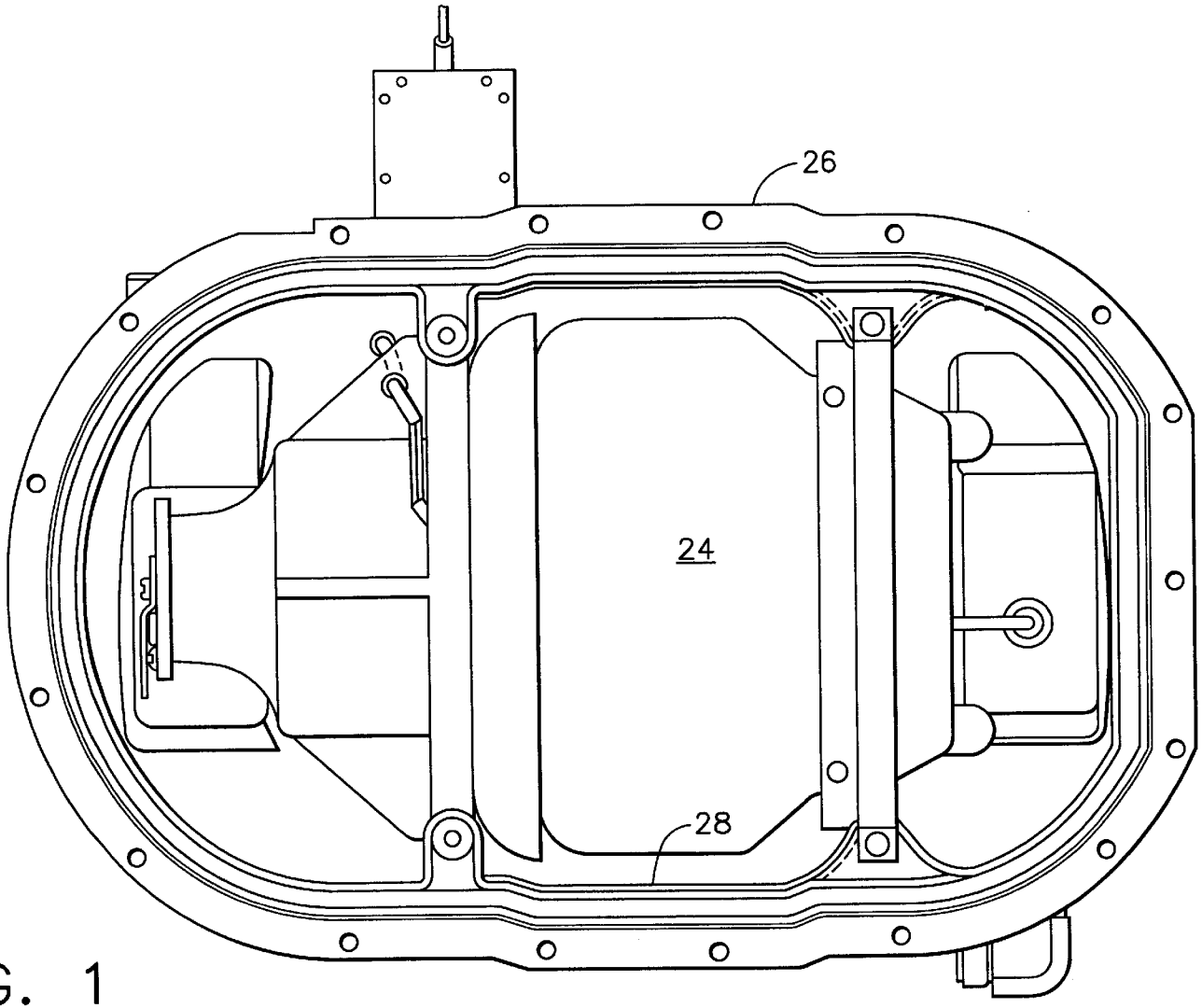
FIG. 1 is a representative x-ray tube structure illustrating an electroplated coating layer for an x-ray tube casing, in accordance with the present invention.

The present invention relates to rotating x-ray tubes, and particularly to x-ray tube casings. In a typical assembly, the lead surface of the x-ray tube casing is coated with a paint layer. Referring now to FIG. 1, a representative illustration of an x-ray tube casing 26 is shown. The x-ray tube casing 26 encases an x-ray tube structure 24, including an anode assembly for distributing heat generated at a focal spot and a cathode assembly for producing x-rays upon impact with the anode.

In any x-ray tube system, certain of the surfaces are necessarily lead surfaces. The purpose of the present invention is to provide a more adherent and durable coating 28 for the lead surfaces of the lead-lined x-ray tube casing 26, replacing the paint layer of the prior art which causes certain disadvantages. With the present invention, all lead surfaces can be electroplated with coating 28, such as is indicated in FIG. 1. The purpose of the coating 28 is to prevent the leakage of x-rays in directions other than through the window of the tube. It is well known in the art that the lead lining is exposed to a dielectric cooling oil which removes heat from the tube insert during operation. Hence, the coating 28 of the present invention prevents lead contamination of the dielectric cooling oil.

It will be obvious to those skilled in the art that various metals can be used to create the adherent and durable coating 28 for electroplating any lead surfaces in accordance with the present invention, including, for example, silver, copper, nickel or tin, or various combinations of these or other metals. In a preferred embodiment of the present invention, the electroplated layer 28 comprises tin. Electrodeposits of tin are corrosion resistant and non-toxic, possess excellent solderability and are noted for softness and ductility.

Electroplating lead radiation shield material with tin provides a clean corrosion resistant surface which is inert to the oil independent of temperature and x-ray irradiation. The electroplated layer preserves the lead surface from flaking and corroding to the oil. The higher thermal conductivity of tin versus the paint of the existing art allows a higher rate of heat transfer from the oil to the casing wall and lowers bulk oil temperature. The high ductility of tin allows the electroplated layer to conform to the lead without cracking when the lead is deformed in a radius of 1 cm. The problems of the prior art, such as poor adherence, cracking with deformation, and flaking that occurs with paint coatings on the lead, are not present for the electroplated lead according to the present invention.

It is known, of course, that the casings of x-ray tubes are lined with lead to prevent the leakage of x-rays in directions other than through the window of the tube. This lead is exposed to dielectric cooling oil which removes heat from the tube insert during operation. X-ray exposure causes a gradual breakdown in the oil, forming smaller and less saturated compounds. The lead readily oxidizes and a combination of this oxide and particles on the lead surface make coating the lead necessary to prevent oil contamination.

Currently, various epoxy type paints have been used for this purpose, but the lead provides a poor surface for adherence and the hot oil, x-rays and chemicals generated during the x-ray exposure of the oil all gradually promote flaking of the paint from the surface. Hence, in accordance with the present invention, electroplating of the lead is evaluated as a replacement for the paint coatings.

Several electroplated metal coatings were applied to a lead sheet of the same thickness used for casing linings. The metals were selected for a combination of corrosion resistance, ductility and compatibility with lead in terms of the plating chemistry. The coatings selected and tested in accordance with the present invention include silver, copper, tin and nickel plating applied in thicknesses of 0.0005, 0.001, and 0.002 inches. The lead samples were 4 inches by 4 inches square and 0.1 inch thick. A 0.001 inch thick sample of each was bent to a radius of about 0.25 inches and sealed in a glass airtight bottle containing about one liter of dielectric oil. An additional bottle containing only dielectric oil was sealed as a control sample. The five bottles were stored in a 100 C. oven and the breakdown voltage of the oil in each jar measured every 5 to 7 days for a period of 6 weeks. At least five breakdown measurements were taken from each sample during each week and the results averaged.

The results of this test indicate that the silver plating had the least drop in average breakdown voltage as well as the least variation in the readings. The results for tin plating were similar although slightly worse. Nickel plating gave inconsistent results, while the copper plated sample deteriorated continually. This deterioration visibly darkened the oil, and formed a precipitate and an attacked copper surface.

Figure 2:
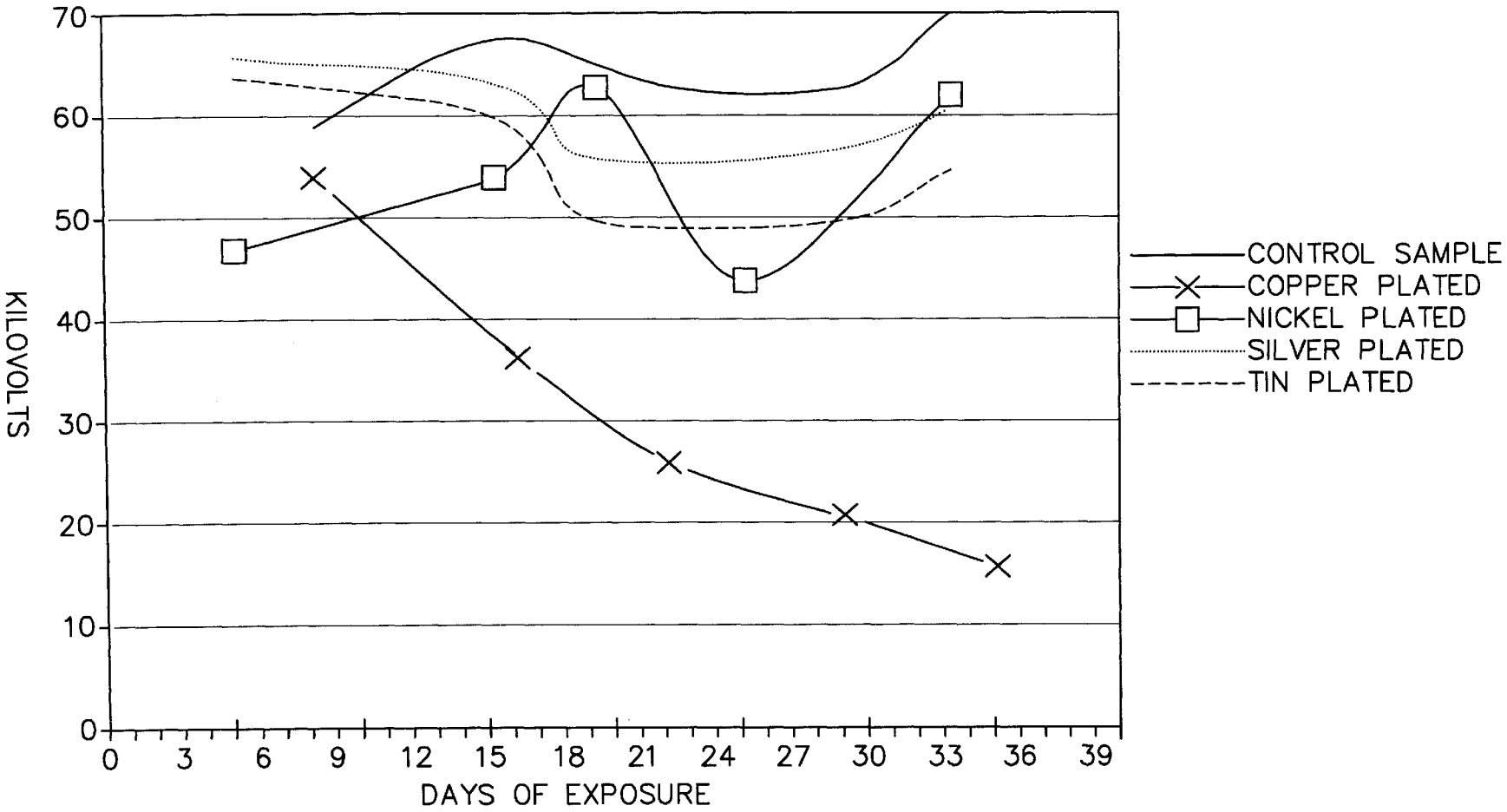
FIG. 2 is a graphical representation of oil breakdown versus oil exposure on the electroplated coating layer of FIG. 1.

The data is as follows from the above-described tests is listed below, and graphically illustrated in FIG. 2:

| days of exposure | | | | | |
|---|---|---|---|---|---|
| nickel | control | silver | copper | tin | |
| 5 | — | 66 | — | 64 | 47 |
| 8 | 59 | — | 54 | — | — |
| 15 | 67.6 | 63.4 | — | 60.2 | 54 |
| 16 | — | — | 36.6 | — | — |
| 19 | — | 56 | — | 50 | 63 |
| 22 | 63 | — | 26 | — | — |
| 25 | — | — | — | — | 44 |

-continued

| days of exposure | | | | | |
|---|---|---|---|---|---|
| nickel | control | silver | copper | tin | |
| 29 | 63 | 57 | 2.1 | 50 | — |
| 33 | 70 | 61 | — | 55 | 62 |
| 35 | — | — | 16 | — | — |

The oil from the above baked exposure tests were analyzed by gas chromatography and arc emission spectroscopy to check for possible chemical reaction between the oil and the metal coatings. Scans were also made of the oil from each test on a Mattheson Galaxy model 3000 Fourier Transform Infrared Spectrophotometer. There was no significant difference in the concentrations of hydrogen, oxygen, nitrogen, methane, carbon dioxide, carbon monoxide, ethylene or ethane in the various oil samples as measured by the gas chromatograph. The infrared spectrographs of the samples were also identical. Therefore, there did not appear to be any chemical reactions occurring as a result of the metal exposure that changed the composition of the oil. Additionally, the oil with the plated lead samples was exposed to radiation in a test box for 2 weeks. The glass in the bottles darkened considerably. The average of five breakdown voltages measurements for each sample after this exposure were as follows:

| | |
|---|---|
| Control sample | 65 KV |
| Nickel Plated Sample | 67 KV |
| Tin Plated Sample | 68 KV |
| Silver Plated Sample | 62 KV |

This data indicates that there is no reaction between the irradiated oil and the plated surface that affects the breakdown voltage. The excellent dielectric strength of the irradiated oil may be the result of the destruction of oxygen and water by the reactive molecules formed by x-ray damage of the oil.

The irradiated oil was again tested by gas chromatography and Fourier transform infrared spectroscopy to identify possible metal exposure dependent chemical changes in the oil during irradiation. The gas chromatography results in ppm by weight are:

| gas | control | tin | silver | nickel |
|---|---|---|---|---|
| oxygen | 6326 | 6724 | 6036 | 7653 |
| hydrogen | 534 | 372 | 145 | 0 |
| nitrogen | 21980 | 21507 | 20160 | 21956 |
| methane | 79 | 19 | 20 | 10 |
| carbon monoxide | 0 | 0 | 146 | 0 |
| carbon dioxide | 590 | 356 | 466 | 374 |
| ethylene | 132 | 23 | 24 | 11 |
| ethane | 57 | 10 | 11 | 3 |
| acetylene | 21 | 6 | 7 | 16 |

Hydrocarbon values are higher for the control samples, but this can be attributed to the lead samples shielding a significant volume of oil from radiation exposure during the testing. The absence of hydrogen and carbon monoxide in the nickel plated sample may be the result of the affinity of nickel for hydrogen gas and carbon monoxide. Nickel is used as a catalyst for reactions with both of these gases. Air contamination was by far the biggest contributor to dissolved gas in all cases. There was no observed change in the condition of any of the samples as a result of exposure to irradiated oil.

Figure 3:
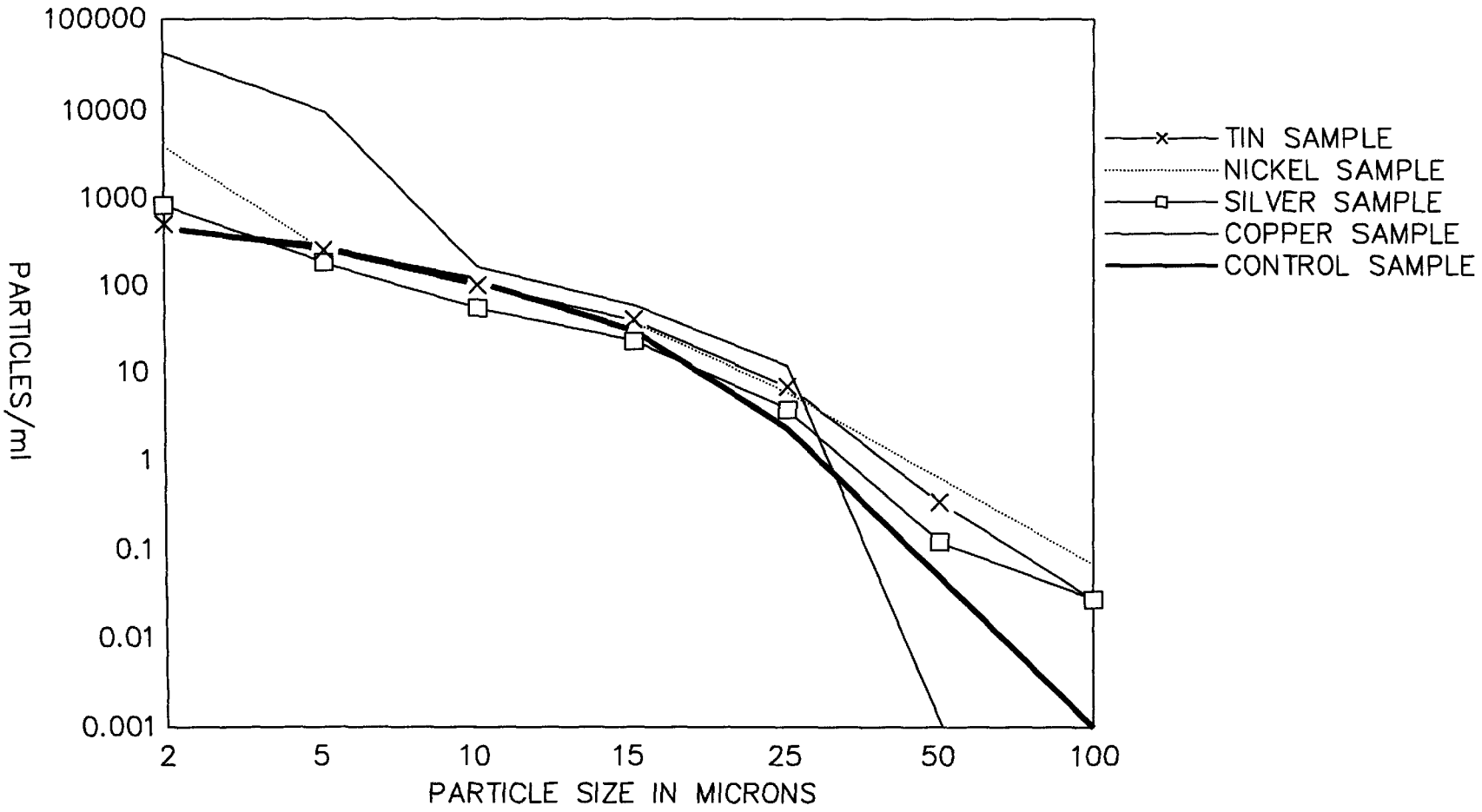
FIG. 3 is a graphical representation illustrating particle counts after application of the electroplated coating layer of FIG. 1.

Gas chromatograph results were identical to those of the oil before irradiation. Furthermore, the results indicate that there is no significant measurable change in oil chemistry. The oil that had been baked with the plated samples was analyzed with a Ricoh laser liquid particle counter and the following data was obtained, and is also graphically illustrated in FIG. 3, showing the number of particles (of varying particle sizes) in each of the samples:

| particle size | Tin | Nickel | Silver | Copper | Control |
|---|---|---|---|---|---|
| 2 | 523.4 | 4172 | 824.7 | 45668 | 467.6 |
| 5 | 235.4 | 258.9 | 173.4 | 9130 | 262.3 |
| 10 | 91 | 92 | 51.6 | 149.3 | 99.4 |
| 15 | 33.6 | 33.4 | 20 | 50.4 | 27 |
| 25 | 5.9 | 5.2 | 3.3 | 10.1 | 1.9 |
| 50 | 0.27 | 0.53 | 0.1 | 0.001 | 0.05 |
| 100 | 0.02 | 0.05 | 0.02 | 0.001 | 0.001 |

As can be seen from the table above, the copper sample, and to a lesser extent the nickel sample, showed a significant increase in the number of small particles in the oil. The copper sample had very few large particles; perhaps the precipitation of the small particles grew on the larger particles and made them settle out so they were not counted. The silver and tin samples were not significantly different than the control sample of clean oil. There were significant numbers of metallic particles observed in the filter from the oil exposed to the nickel plating. The filter from the control, tin and silver plated samples had nearly all organic fibers and other nonmetallic particles. The filter from the copper sample was covered with several layers of crystalline colorless particles which apparently are the result of a chemical reaction between the copper and the oil.

The baked oil samples were then submitted to induction coupled plasma emission analysis. In all cases, the concentrations of lead and the plated metals were below the detection limit, indicating that there was no migration of the metals into the oil at part per million levels.

Electrodeposits of tin are corrosion resistant and nontoxic, possess excellent solderability, and are noted for their softness and ductility. Because of their solderability, electrotin coatings are employed on electronic components, electrical lugs and connectors. In a preferred embodiment of the present invention, the recommended thickness of tin, when tin is the electroplate coating 28 of FIG. 1, on the lead, is 2.0 mil. Tin may be plated from alkaline stannate baths or from acid solutions of sulfate or fluoborate. In a preferred embodiment, the tin is plated using a sulfate bath method because acid tin baths have higher cathode efficiency than alkaline stannate baths. This is because in acid baths tin is plated from the bivalent form, rather than from the quadrivalent form, as in the alkaline baths. This tin electrodeposit method can be operated at cathode current densities of 10 to 100 amp per square foot, depending on the concentration and nature of the addition agent.

Electroplating lead radiation shield material with tin provides a clean corrosion resistant surface which is inert to the oil independent of temperature and x-ray irradiation. It preserves the lead surface from flaking and corroding to the oil. The higher thermal conductivity of the tin versus the paint of the prior art allows a higher rate of heat transfer from the oil to the casing wall and lowers bulk oil temperature.

The high ductility of tin allows the tin to conform to the lead without cracking when the lead is deformed in a radius of 1 cm, and to create a self-healing system, whereby minor scratches repair themselves. The problems of poor adherence, cracking with deformation, and flaking that occurs with paint coatings of the prior art are not present for the lead electroplating method of the present invention.

In accordance with the present invention, the lead can be formed to shape after the lead is plated. This deformation would cause increased delamination if performed on painted surfaces of the prior art. Furthermore, having the lead surface electroplated with a metal results in increasing the thermal conductivity from the oil to the casing which is supplied with fins for casing-air heat transfer. This results in a lower oil operating temperature compared to the painted lead lining of the prior art. Electroplating eliminates the environmental and regulatory problems associated with the volatile organic compounds in the paint.

The invention has been described in detail with particular reference to certain preferred embodiments thereof, but it will be understood that modifications and variations can be effected within the spirit and scope of the invention.

What is claimed is:

1. A rotating x-ray tube comprising:

an anode assembly for distributing heat generated at a focal spot;

a cathode assembly for producing x-rays upon impact with the anode;

a casing for housing the x-ray tube, the casing having a lead lining, the lead lining being exposed to a dielectric cooling oil; and an electroplating material for coating the casing to prevent lead contamination of the dielectric cooling oil.

2. A rotating x-ray tube as claimed in claim 1 wherein the electroplating material comprises tin.

3. A rotating x-ray tube as claimed in claim 1 wherein the electroplating material comprises silver.

4. A rotating x-ray tube as claimed in claim 1 wherein the lead lining of the casing material prevents unwanted leakage of x-rays.

5. A rotating x-ray tube as claimed in claim 1 wherein the electroplating material imparts insulating properties to the lead lining.

6. An x-ray tube casing comprising:

a lead lining for preventing unwanted leakage of x-rays, the lead lining being exposed to a dielectric cooling oil; and an electroplating material for coating the lead lining to prevent contamination of the dielectric cooling oil.

7. An x-ray tube casing as claimed in claim 6 wherein the electroplating material is selected from the group consisting of silver, copper, tin, nickel and combinations of silver, copper, tin and nickel.

8. An x-ray tube casing as claimed in claim 7 wherein the electroplating material comprises tin.

9. An x-ray tube casing as claimed in claim 8 wherein the tin has a thickness of approximately 2.0 mil.

10. A method for providing an adherent and durable coating for an x-ray tube casing comprising the steps of:

lining surfaces of the x-ray tube with lead;

exposing the lead lined surfaces to a dielectric cooling oil; and coating the lead lined surfaces with an electroplating material to prevent contamination of the dielectric cooling oil.

11. A method as claimed in claim 10 wherein the electroplating material comprises a corrosion resistant material.

12. A method as claimed in claim 10 wherein the electroplating material comprises a nontoxic material.

13. A method as claimed in claim 10 wherein the electroplating material comprises a ductile material.

* * * * *